US008381405B2

(12) United States Patent
Shigeta et al.

(10) Patent No.: US 8,381,405 B2
(45) Date of Patent: Feb. 26, 2013

(54) ELECTRIC SHAVER

(75) Inventors: Hiroshi Shigeta, Fujiidera (JP); Masanobu Yamasaki, Hikone (JP); Shin Hosokawa, Hikone (JP); Takeshi Shiba, Hikone (JP); Jyuzaemon Iwasaki, Nagahama (JP)

(73) Assignee: Panasonic Corporation, Osaka (JP)

( * ) Notice: Subject to any disclaimer, the term of this patent is extended or adjusted under 35 U.S.C. 154(b) by 457 days.

(21) Appl. No.: 12/649,440

(22) Filed: Dec. 30, 2009

(65) Prior Publication Data

US 2010/0175260 A1 Jul. 15, 2010

(30) Foreign Application Priority Data

Jan. 15, 2009 (JP) ..... 2009-006427

(51) Int. Cl.
*B26B 19/02* (2006.01)

(52) U.S. Cl. ..... 30/34.1; 30/43; 30/43.92

(58) Field of Classification Search ..... 30/34.1, 30/43, 41.9, 43.92, 47
See application file for complete search history.

(56) References Cited

U.S. PATENT DOCUMENTS

| | | | | |
|---|---|---|---|---|
| 4,930,217 | A | 6/1990 | Wolf et al. | |
| 5,052,106 | A * | 10/1991 | Labrijn | 30/34.1 |
| 5,084,967 | A * | 2/1992 | Nakagawa et al. | 30/34.1 |
| 5,701,673 | A * | 12/1997 | Ullmann et al. | 30/34.1 |
| 6,317,982 | B1 | 11/2001 | Andrew | |
| 7,461,456 | B2 * | 12/2008 | Tsushio et al. | 30/43.92 |
| 7,707,725 | B2 * | 5/2010 | Eichhorn et al. | 30/34.1 |
| 2005/0028371 | A1 | 2/2005 | Kakimoto | |
| 2007/0022607 | A1 | 2/2007 | Takeuchi et al. | |
| 2008/0282576 | A1 | 11/2008 | Ueda et al. | |
| 2008/0307653 | A1 | 12/2008 | Wattam | |
| 2008/0313909 | A1 | 12/2008 | Haczek et al. | |
| 2009/0241343 | A1 | 10/2009 | Yamasaki et al. | |

FOREIGN PATENT DOCUMENTS

| | | |
|---|---|---|
| DE | 102005044175 | 3/2007 |
| EP | 1504859 | 2/2005 |
| GB | 2118886 | 11/1983 |
| JP | 57-037472 | 3/1982 |
| JP | 64-056089 | 3/1989 |
| JP | 6-343776 | 12/1994 |
| JP | 2001-232074 | 8/2001 |
| JP | 2002-315978 | 10/2002 |
| JP | 2004-049864 | 2/2004 |
| JP | 2005-052466 | 3/2005 |

(Continued)

OTHER PUBLICATIONS

Russia Office action, dated Oct. 2010 along with an English translation thereof.

(Continued)

*Primary Examiner* — Sean Michalski
(74) *Attorney, Agent, or Firm* — Greenblum & Bernstein, P.L.C.

(57) ABSTRACT

An electric shaver including: a gripper portion to be held by the user's hand; and a head portion configured to hold a shaving-blade unit and supported to be swingable in predetermined directions with respect to the gripper portion, wherein the head portion is provided with: an edge-trimmer-blade unit configured to be switched between a ready-for-use state and a stored state by an operation element; and a engaging portion for fixing the head portion, the engaging portion configured to be engaged with the operation element when the edge-trimmer-blade unit is switched to the ready.

4 Claims, 16 Drawing Sheets

FOREIGN PATENT DOCUMENTS

| | | |
|---|---|---|
| JP | 2005-304793 | 11/2005 |
| JP | 2006-42897 | 2/2006 |

OTHER PUBLICATIONS

U.S. Appl. No. 12/644,557 to Shigeta et al., filed Dec. 22, 2009.
U.S. Appl. No. 12/644,696 to Shimizu et al., filed Dec. 22, 2009.
U.S. Appl. No. 12/649,447 to Shimizu et al., filed Dec. 30, 2009.
Japan Office action, dated Sep. 20, 2011 along with an English language translation thereof.
E.P.O. Office action, dated Jul. 29, 2011.
China Office action, dated Jul. 12, 2011 along with an English language translation thereof.

* cited by examiner

ELECTRIC SHAVER

BACKGROUND OF THE INVENTION

1. Field of the Invention

The present invention relates to an electric shaver in which a head portion holding a shaving-blade unit including an inner blade and an outer blade is supported to be swingable in predetermined directions with respect to a gripper portion.

2. Description of the Related Art

Japanese Patent Application Publication No. 2002-315978 discloses an electric shaver of the above-mentioned kind, which includes not only a shaving-blade unit including an inner blade and an outer blade but also an edge-trimmer-blade unit.

The electric shaver includes a gripper portion to be held by the user's hand and a head portion configured to hold the shaving-blade unit, and supported to be swingable in the anteroposterior directions with respect to the gripper portion. Moreover, the electric shaver includes the edge-trimmer-blade unit in an upper-side portion on the back-side surface of the gripper portion. A switching knob is provided in the gripper portion to switch the edge-trimmer-blade unit between a ready-for-use state (a popped-up state) and a stored state.

SUMMARY OF THE INVENTION

In the conventional electric shaver, however, a lock switch and a switching knob are provided as separate members in the gripper portion. Here, the lock switch is configured to lock the head portion configured to swing in the anteroposterior directions with respect to the gripper portion. The switching knob is configured to switch the edge-trimmer-blade unit between the ready-for-use state and the stored state. Providing the lock switch and the switching knob as separate members increases the number of component parts, makes the overall structure more intricate, and raises the manufacturing cost.

An object of the present invention, made to solve the above-mentioned problem, is to provide an electric shaver not needing a switch to lock the head portion, thereby reducing the number of component parts, simplifying the overall structure, and reducing the manufacturing cost.

An aspect of the present invention is an electric shaver including: a gripper portion to be held by the user's hand; and a head portion configured to hold a shaving-blade unit and supported to be swingable in predetermined directions with respect to the gripper portion, wherein the head portion is provided with: an edge-trimmer-blade unit configured to be switched between a ready-for-use state and a stored state by an operation element; and a engaging portion for fixing the head portion, the engaging portion configured to be engaged with the operation element when the edge-trimmer-blade unit is switched to the ready-for-use state by an operation of the operation element.

DESCRIPTION OF THE PREFERRED EMBODIMENT

Figure 1:
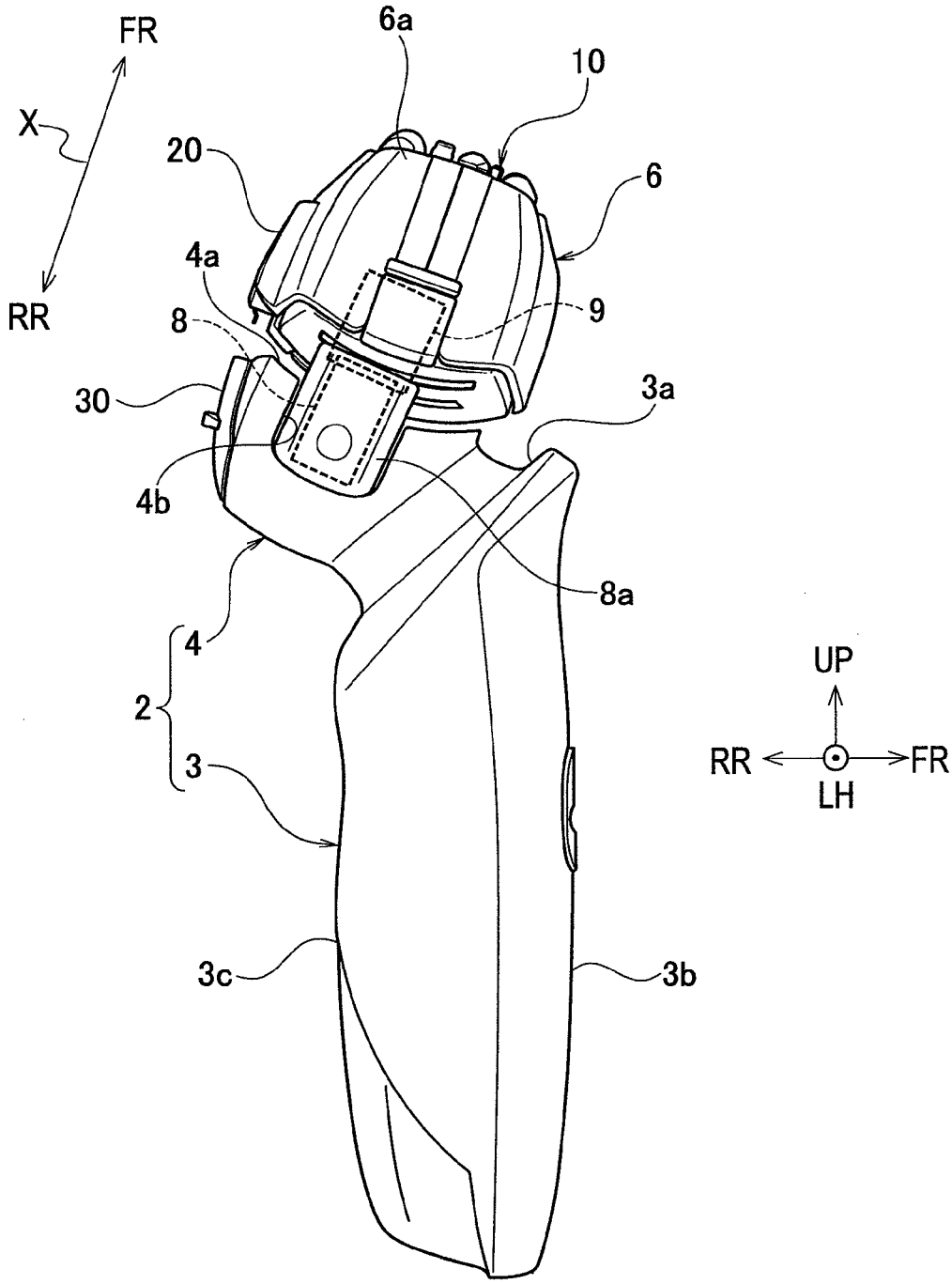
FIG. 1 is a side view illustrating an electric shaver according to a first embodiment of the present invention
Figure 2:
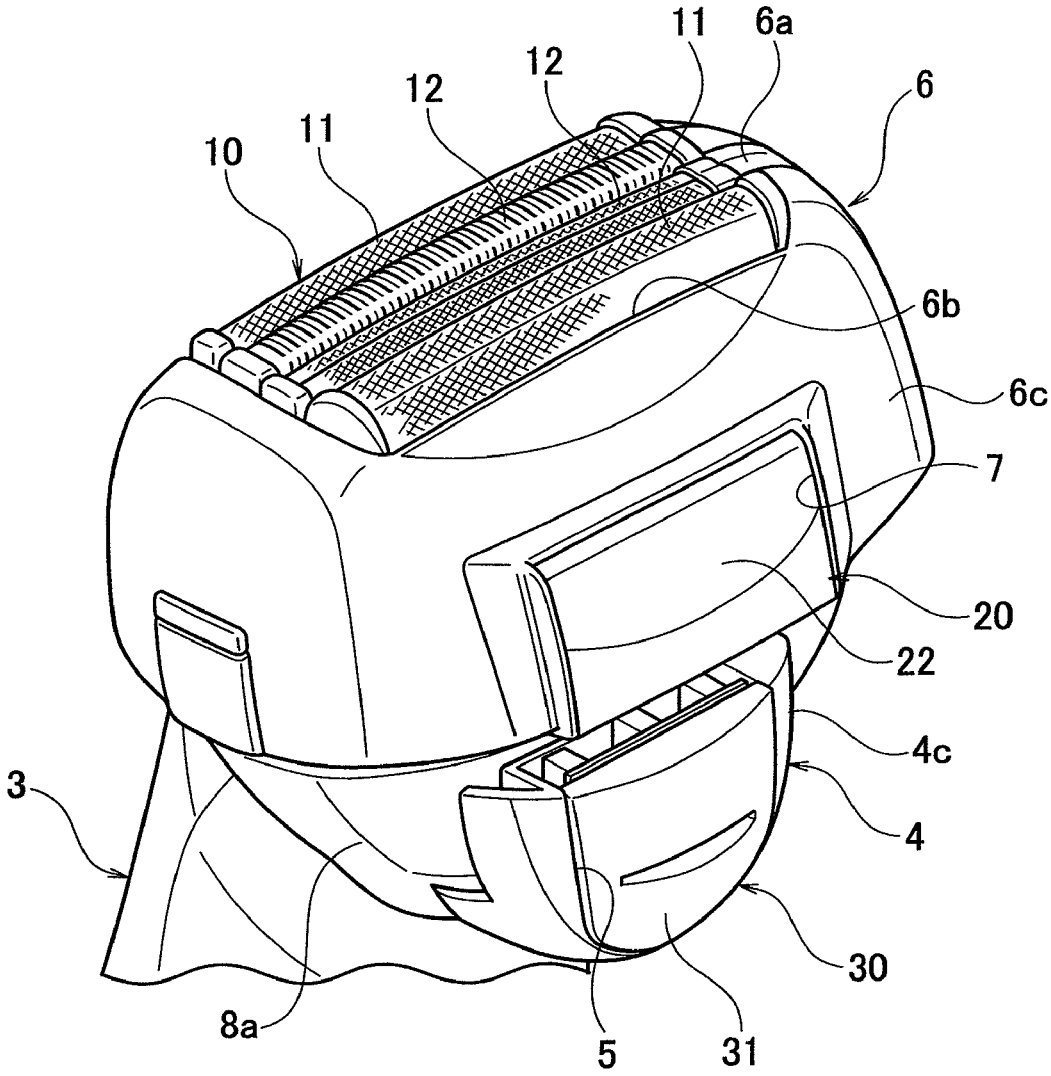
FIG. 2 is a perspective view illustrating a principal portion of the electric shaver.
Figure 3:
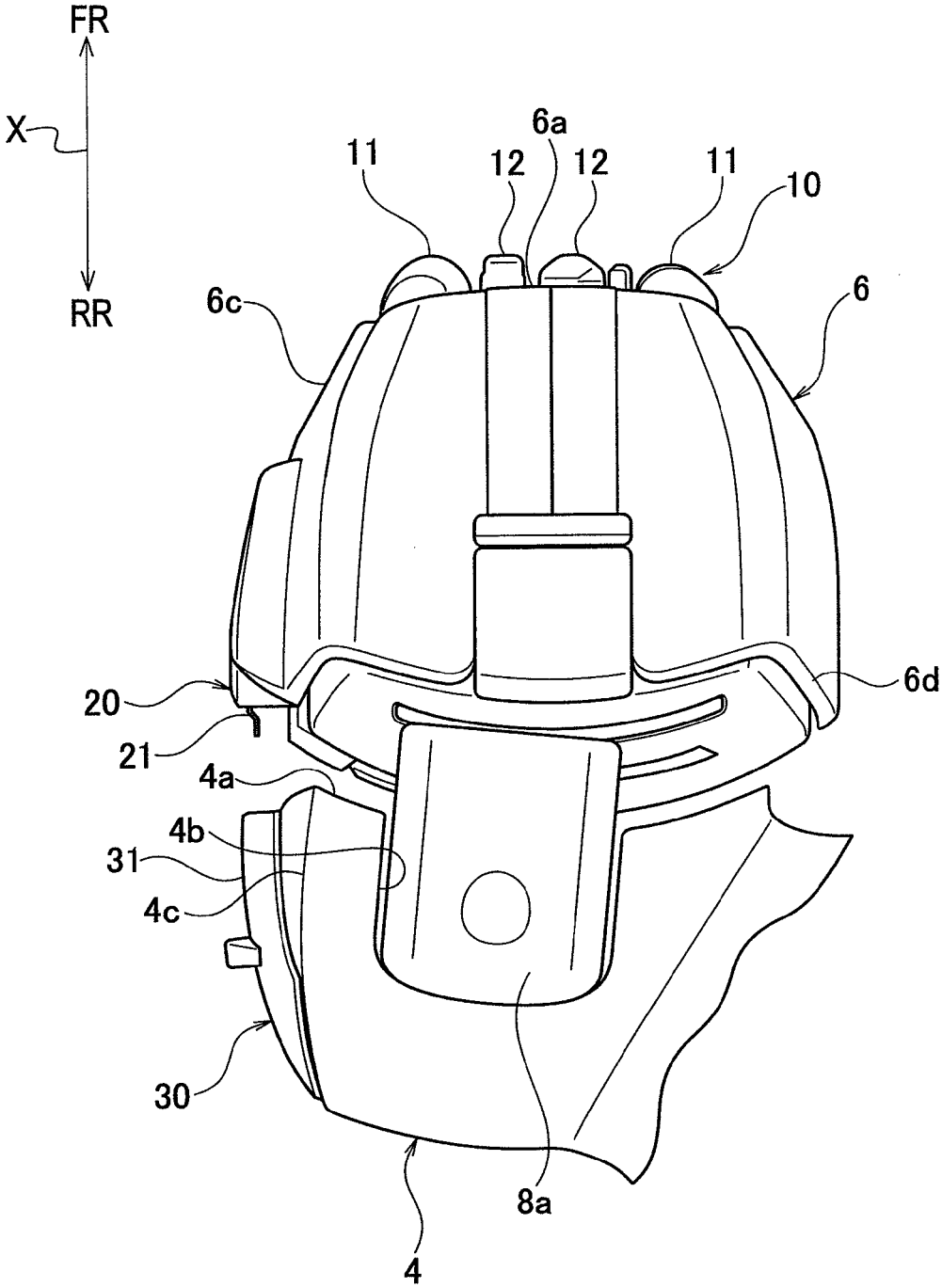
FIG. 3 is a side view illustrating the principal portion of the electric shaver before the operation of an operation element.
Figure 4:
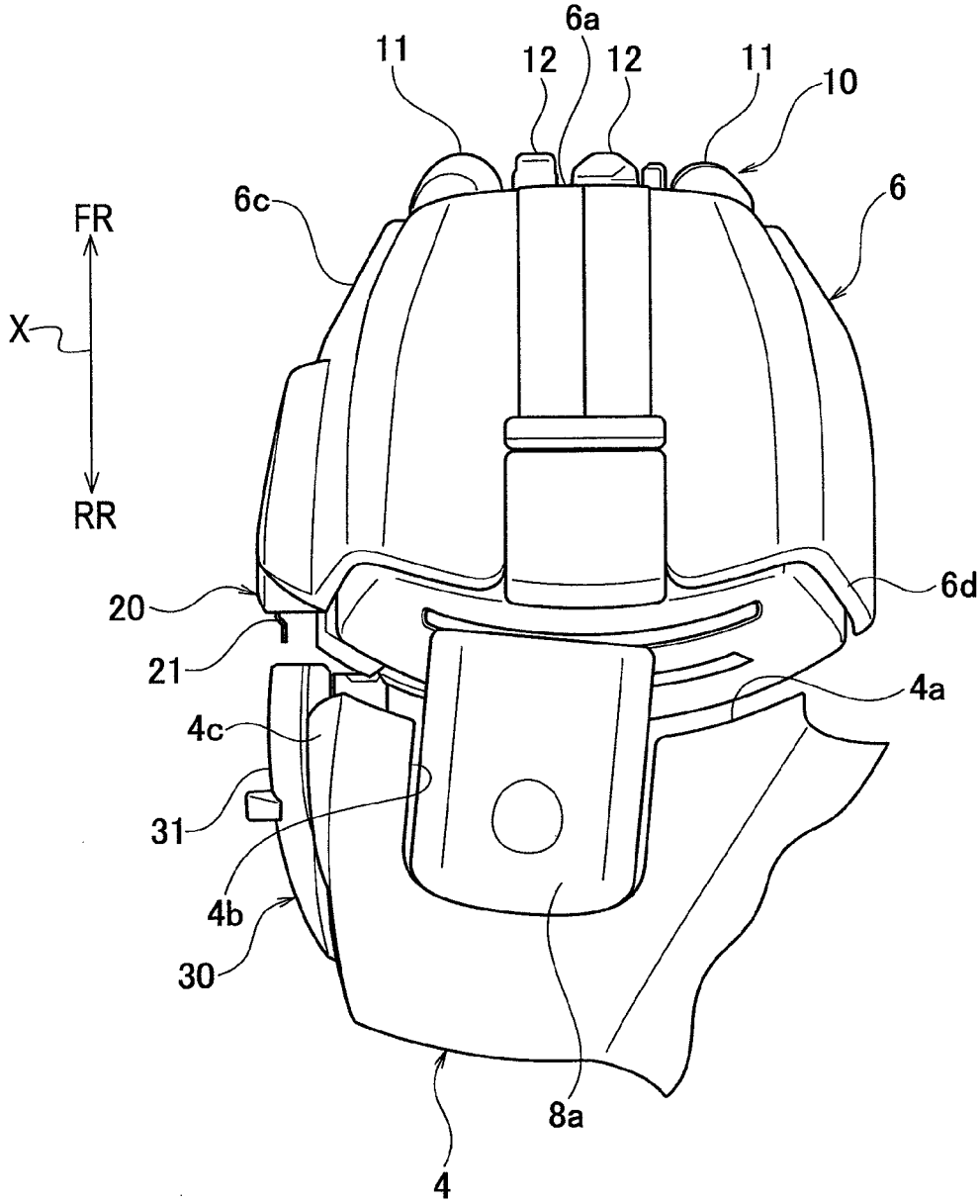
FIG. 4 is a side view illustrating the principal portion of the electric shaver at the time of a first operation of the operation element.

Some embodiments of the present invention will be described below by referring to the drawings.

Figure 15:
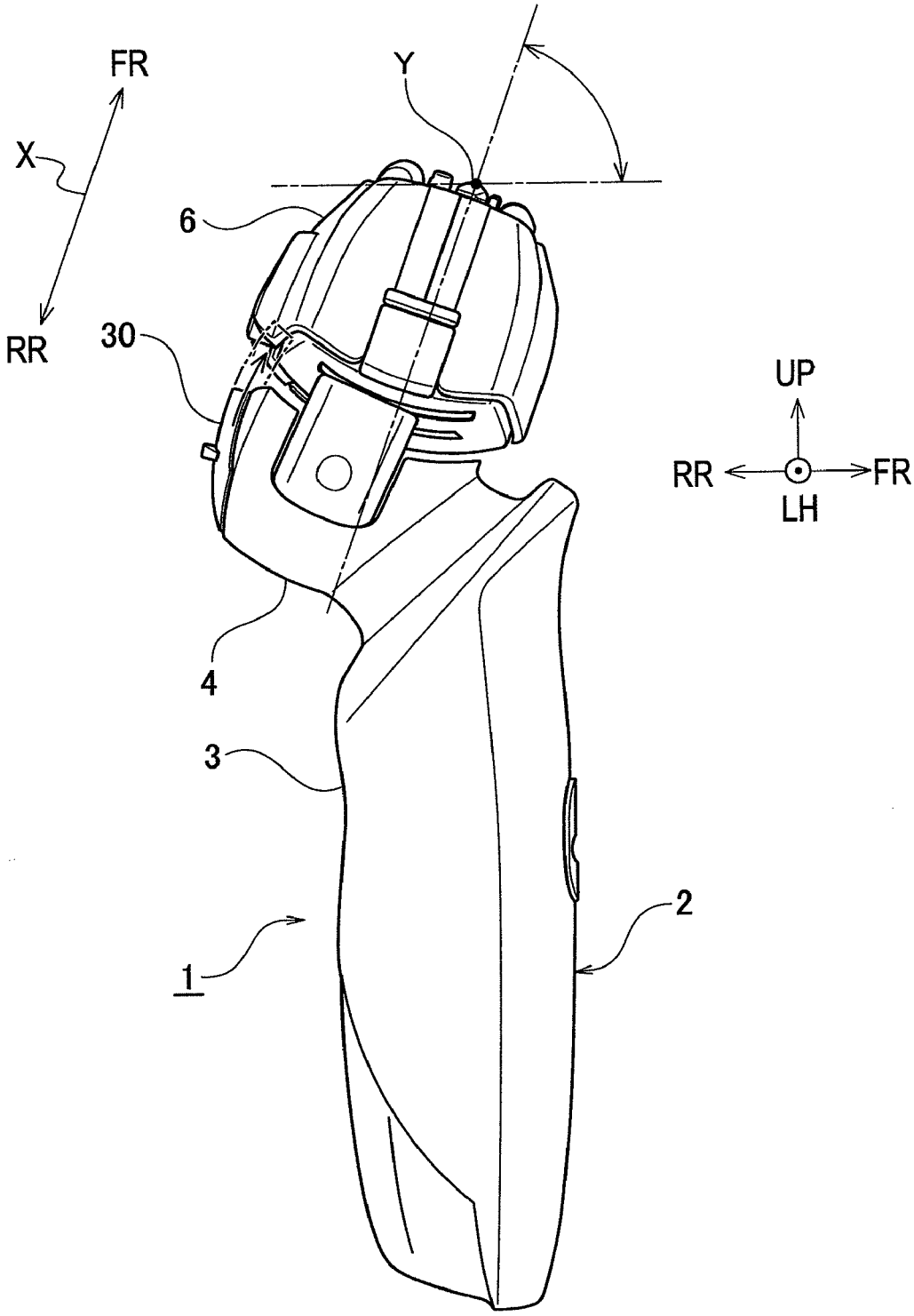
FIG. 15 is a side view illustrating the directions of the operation of the operation element.

As FIGS. 1 and 15 show, an electric shaver 1 according to a first embodiment of the present invention includes a gripper portion 2 and a head portion 6. The gripper portion 2 is the portion that the user grips with his/her hand. The head portion 6 holds a shaving-blade unit 10 and is supported by the gripper portion 2 in such a manner as to be swingable in the anteroposterior directions and/or in the lateral directions with respect to the gripper portion 2.

The gripper portion 2 includes a gripper main body 3 and a gripper connecting portion 4. The gripper main body 3 is made of a synthetic resin, and includes a front-side surface 3*b*, a back-side surface 3*c*, and an upper-side surface 3*a*. The upper-side surface 3*a* slopes downwards from the front-side surface 3*b* to the back-side surface 3*c*. The gripper connecting portion 4 is made of a synthetic resin, and protrudes obliquely upwards to the rear from the upper-side surface 3*a* of the gripper main body 3.

A recessed portion 4*b* is formed at the center, in the anteroposterior directions, of an upper-side surface 4*a* of the gripper connecting portion 4. A lateral swing mechanism 8 is provided in the recessed portion 4*b*, and is configured to swing the head portion 6 in the lateral directions with respect to the gripper portion 2. An anteroposterior swing mechanism 9 is provided between the lateral swing mechanism 8 and the head portion 6, and is configured to swing the head portion 6 in the anteroposterior directions with respect to the gripper portion 2.

In addition, as FIGS. 1 to 8 show, an opening portion 6*b* is formed in an upper-side surface 6*a* of the head portion 6, and the shaving-blade unit 10 is provided in the opening portion 6*b*. A recessed portion 7 is formed in a back-side surface 6*c* of the head portion 6, and an edge-trimmer-blade unit 20 that has a substantially flat shape is provided in the recessed portion 7.

In addition, a recessed portion 5 is formed in a back-side surface 4*c* of the gripper connecting portion 4 of the gripper portion 2. An operation element 30 that is made of a synthetic resin is provided in the recessed portion 5. The operation element 30 is capable of sliding back and forth in directions that is substantially parallel with a bottom surface 5*a* of the recessed portion 5. Hereafter, the directions will be referred to as the sliding-motion directions X. With the reciprocating motions, the operation element 30 is configured to switch the states of the edge-trimmer-blade unit 20 between a state where the edge-trimmer-blade unit 20 is ready for use (i.e., popped-up state, a state where a plane that is parallel to a principal surface of the edge-trimmer-blade unit 20 intersects with a plane that is parallel to the back-side surface 6*c* of the head portion 6 in this embodiment) and a state where the edge-trimmer-blade unit 20 is retracted to be stored (i.e., folded-up state, a state where the principal surface of the edge-trimmer-blade unit 20 is substantially parallel with the back-side surface 6*c* of the head portion 6). Note that in the following description, a direction in which the operation element 30 comes closer to the head portion 6 is referred to as the forward direction in the sliding-motion direction X, whereas a direction in which the operation element 30 goes away from the head portion 6 is referred to as the backward direction in the sliding-motion direction X.

As FIGS. 3 to 8 show, the shaving-blade unit 10 includes plural net-shaped outer blades 11, 11 and plural slit outer blades 12, 12. The net-shaped outer blades 11, 11 and the slit outer blades 12, 12 are exposed outside from the opening portion 6*b* of the head portion 6. Hairs introduced into the outer blades 11, 12 are cut by inner blades (not illustrated) that are moved back and forth in the lateral directions by the driving element of a linear motor (not illustrated) provided in the head portion 6.

As FIGS. 6 to 11 show, the edge-trimmer-blade unit 20 includes an edge-trimmer blade 21 and a blade holder 22. The edge-trimmer blade 21 is provided at the leading end of the edge-trimmer-blade unit 20. The blade holder 22, which is made of a synthetic resin, holds the edge-trimmer blade 21 and serves also as the cover for the edge-trimmer blade 21. A driving lever 23 (driving element) is connected to the linear motor, and is engaged to a central portion of the base-end portion of the edge-trimmer blade 21. Reciprocating lateral motions of the driving lever 23 make the edge-trimmer blade 21 move back and forth in the lateral directions with respect to the head portion 6. The blade holder 22 includes arc-shaped portions 22*a*, 22*a* at the two side-end portions in the lateral directions of the base-end portion. To rotatably support the arc-shaped portions 22*a*, 22*a*, a pair of pivot shafts 7*a*, 7*a* are formed in such a manner as to protrude respectively from the two side-end portions in the lateral directions of the recessed portion 7 of the head portion 6. In addition, a pair of protruding pieces 22*b*, 22*b* are formed as integral part of the blade holder 22 in such a manner as to protrude from positions located respectively in the two sides in the lateral directions of the base-end portion of the blade holder 22. The position where each protruding piece 22*b* is formed is closer to the leading end of the blade holder 22 than each arc-shaped portion 22*a* is. A circular hole 22*c* is formed in each of the protruding pieces 22*b*, 22*b*. A pair of handle arms 25, 25 are provided in the recessed portion 7 of the head portion 6. Each handle arm 25 is configured to slide back and forth in the sliding-motion directions X along the corresponding one of the two side edges in the lateral directions of a bottom surface 7*b* of the recessed portion 7. A pin portion 25*a* is formed in such a manner as to protrude from the leading end of each handle arm 25. Each pin portion 25*a* is fitted to the circular hole 22*c* of the corresponding protruding piece 22*b* so as to move pivotally. Accordingly, when a base-end portion 25*b* of each handle arm 25 is pushed forward in the sliding-motion direction X by a front-side surface 31*a* of an operation element main body 31 and a second-click elastic leg 33, which are to be described later, each handle arm 25 moves forward in the sliding-motion direction X. With the forward motion of the handle arms 25, 25, the blade holder 22 moves rotationally about the pivot shafts 7*a*, 7*a* to pop up. When the pushing force of the operation element 30 is released, a biasing force exerted by an unillustrated spring member moves each handle arm 25 backward in the sliding-motion direction X. While each handle arm 25 is moving back to the original position, the handle arm 25 moves rotationally the blade holder 22 about the pivot shafts 7*a*, 7*a* in the opposite direction, so that the blade holder 22 is retracted back into the recessed portion 7 of the head portion 6.

As FIGS. 3 to 15 show, the operation element 30 includes: the operation element main body 31; a pair of first-click elastic legs (first elastic legs) 32, 32; the pair of second-click elastic legs (second elastic legs) 33, 33; and a locking member 34. The operation element main body 31 is made of a synthetic resin, and is capable of sliding back and forth in the sliding-motion directions X in the recessed portion 5 formed in the back-side surface 4*c* of the gripper connecting portion 4 of the gripper portion 2. The first-click elastic legs 32, 32 are made of a synthetic resin, and protrude from the back-side surface of the operation element main body 31 in such a manner as to extend backward in the sliding-motion direction X. The second-click elastic legs 33, 33 are made of a synthetic resin, and protrude from the back-side surface of the operation element main body 31 in such a manner as to extend forward in the sliding-motion direction X. The locking member 34 is made of a synthetic resin, and is connected to the back-side surface of the operation element main body 31. The first-click elastic legs 32, 32 and the second-click elastic legs 33, 33 are configured to slide back and forth in the sliding-motion directions X on the bottom surface 5*a* in the recessed portion of the gripper connecting portion 4 along with the reciprocating sliding motions of the operation element main body 31. The locking member 34 has a square U-shape with an open side facing forward in the sliding-motion direction X when viewed from the front side (i.e., when viewed from the front-surface side of the operation element main body 31). The locking member 34 protrudes from the two side-portions in the lateral directions of the gripper connecting portion 4 into a lateral-swing cover 8*a* of the lateral swing mechanism 8.

As FIGS. 3 to 5 and FIG. 15 show, the operation element main body 31 of the operation element 30 is configured to slide back and forth following an arc-shaped trajectory in the recessed portion 5 of the gripper connecting portion 4 of the gripper portion 2. The arc-shaped trajectory on which the operation element main body 31 moves when sliding back and forth can be described in the following way. As FIG. 15 shows, the further forwards the operation element main body 31 moves forward in the sliding-motion direction X, the closer the operation element main body 31 gets to a rotating axis Y for the anteroposterior swinging motions of the head portion 6.

Figure 12:
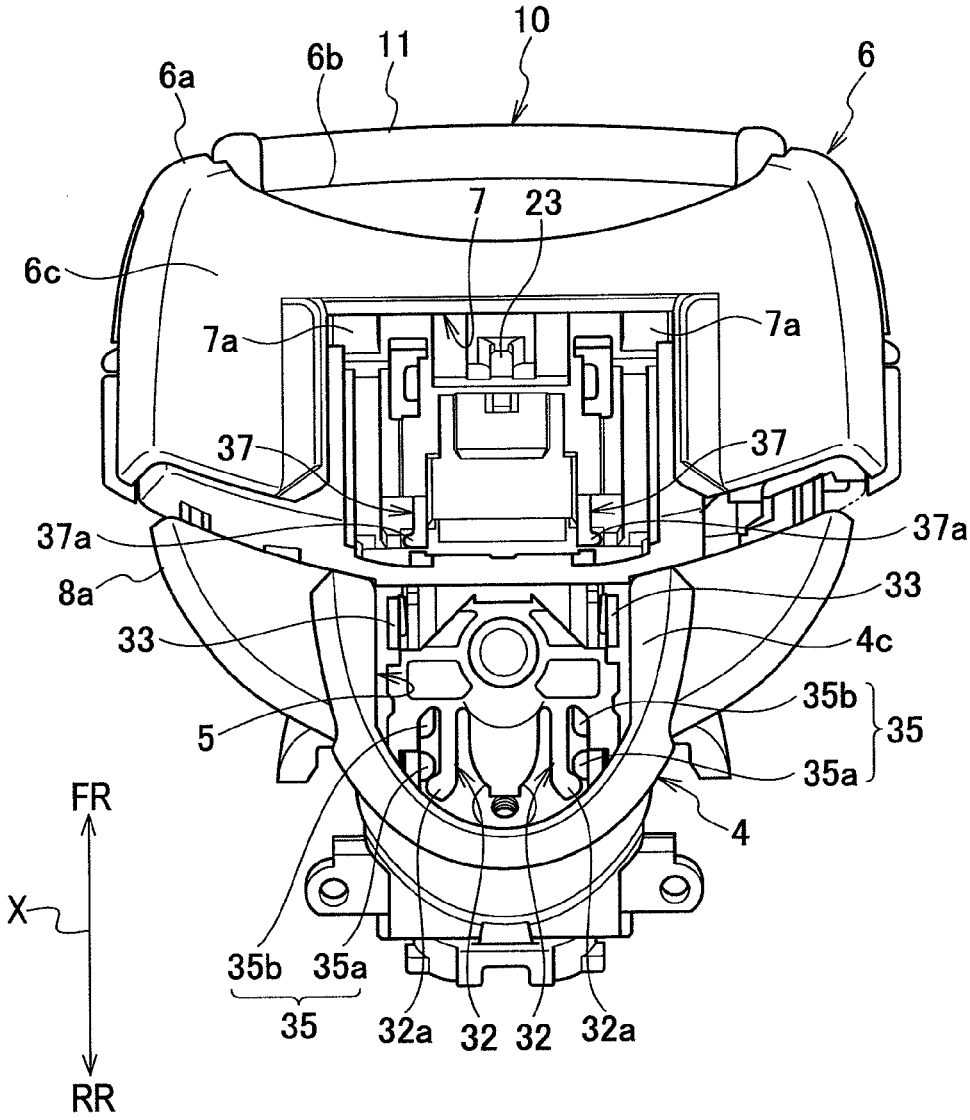
FIG. 12 is a partially-sectional back-side view illustrating the principal portion of the electric shaver before the operation of the operation element.

As FIG. 12 shows, a pair of first-click portions 35, 35 (engaging portions) are formed respectively on the two side-portions in the lateral directions in the recessed portion 5 of the gripper connecting portion 4. Each of the pair of first-click portions 35, 35 includes a first protruding portion 35*a* and a second protruding portion 35*b*. The first protruding portion 35*a* protrudes from the corresponding side wall, in the lateral direction, of the recessed portion 5 towards the center in the lateral direction. The second protruding portion 35*b* also protrudes from the corresponding side wall, in the lateral direction, of the recessed portion 5 towards the center in the lateral direction, but is located forward in the sliding-motion direction X of the first protruding portion 35*a*.

Leading-end protruding portions 32*a*, 32*a* are formed respectively in the backward portions, backward in the sliding-motion direction X, of the first-click elastic legs 32, 32. Before the user operates the operation element 30, that is, while the operation element 30 is at the ordinary position shown in FIGS. 1 to 3, and also in FIGS. 6, 9, and 12, each leading-end protruding portion 32*a* abuts on the backward-end portion, in the sliding-motion directions X, of the corresponding first protruding portion 35*a*. In this state, the head portion 6 is capable of swinging in the anteroposterior directions and/or in the lateral directions with respect to the gripper portion 2. In addition, each handle arm 25 is held at the ordinary position by the biasing force exerted by the unillustrated spring member.

Figure 13:
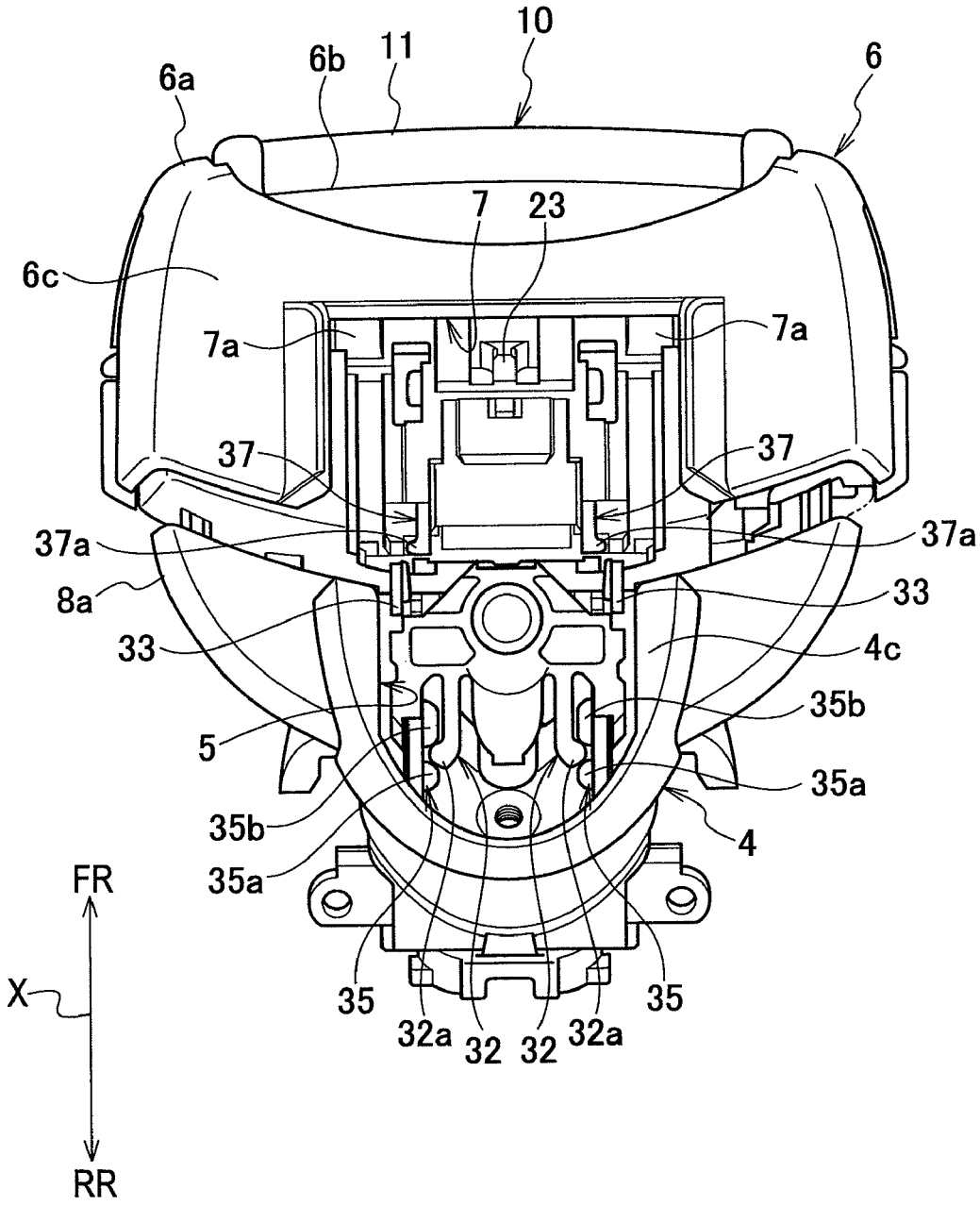
FIG. 13 is a partially-sectional back-side view illustrating the principal portion of the electric shaver at the time of the first operation of the operation element.

In addition, at the time of a first operation (first click) of the operation element 30, that is, when the operation element 30 slides forward in the sliding-motion direction X from the ordinary position and reaches a first-click position shown in FIGS. 4, 7, 10, and 13, each of the leading-end protruding portions 32*a*, 32*a* of the first-click elastic legs 32, 32 is fitted to the space formed between the forward-end portion, in the sliding-motion directions X, of the corresponding first protruding portion 35*a* and the backward-end portion, in the sliding-motion directions X, of the corresponding second protruding portion 35*b*, as FIG. 13 shows.

Figure 10:
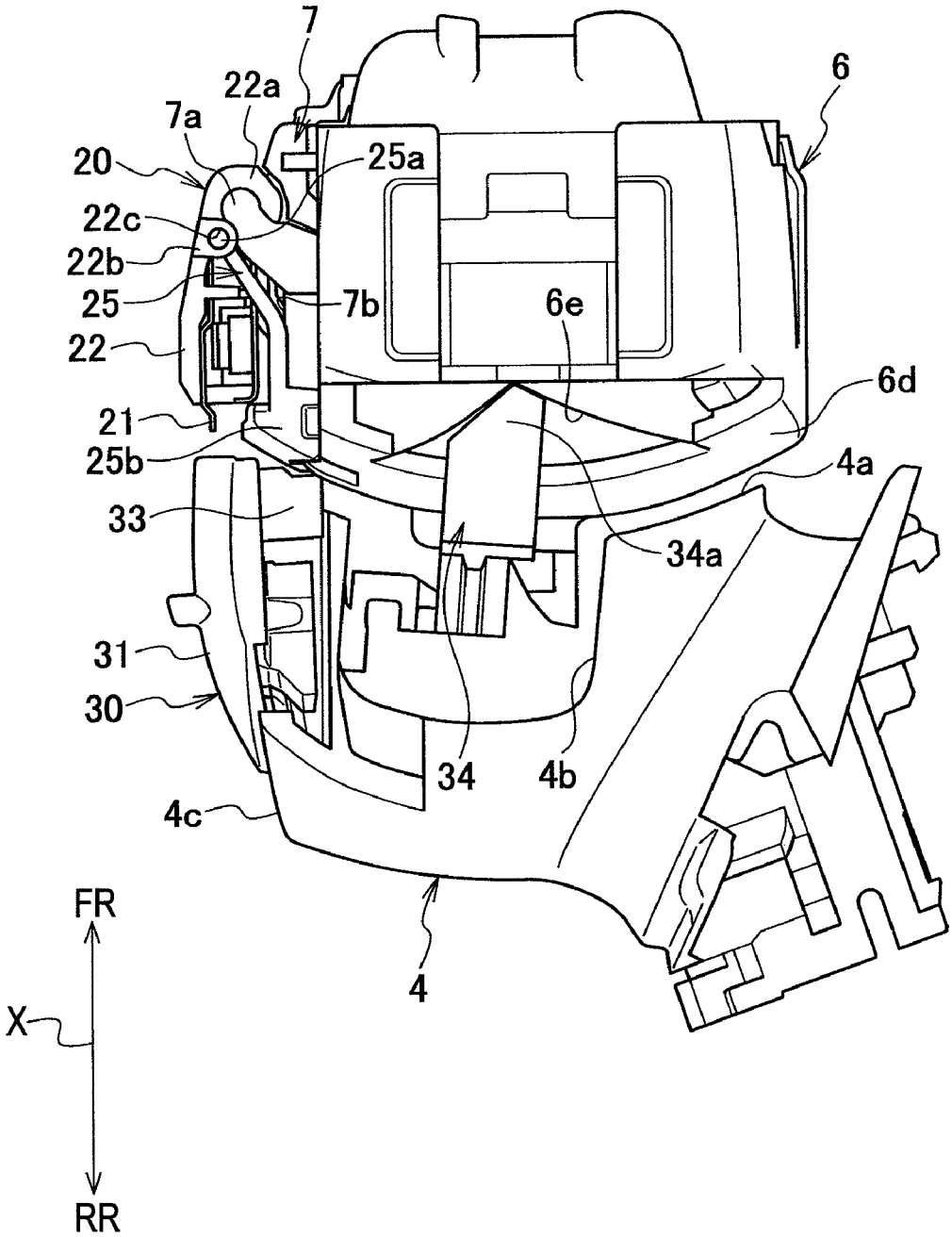
FIG. 10 is a partially-sectional side view illustrating the principal portion of the electric shaver at the time of the first operation of the operation element.

In this state, as FIG. 10 shows, two leading-end portions 34*a*, 34*a* of the locking member 34 are fitted respectively to a pair of recessed portions 6*e*, 6*e* that are formed respectively on the two side-portions of a bottom surface 6*d* of the head portion 6. With the fitting of the leading-end portions 34*a*, 34*a* to the recessed portions 6*e*, 6*e*, the head portion 6 is locked in a fixed position with respect to the gripper connecting portion 4 of the gripper portion 2.

Figure 14:
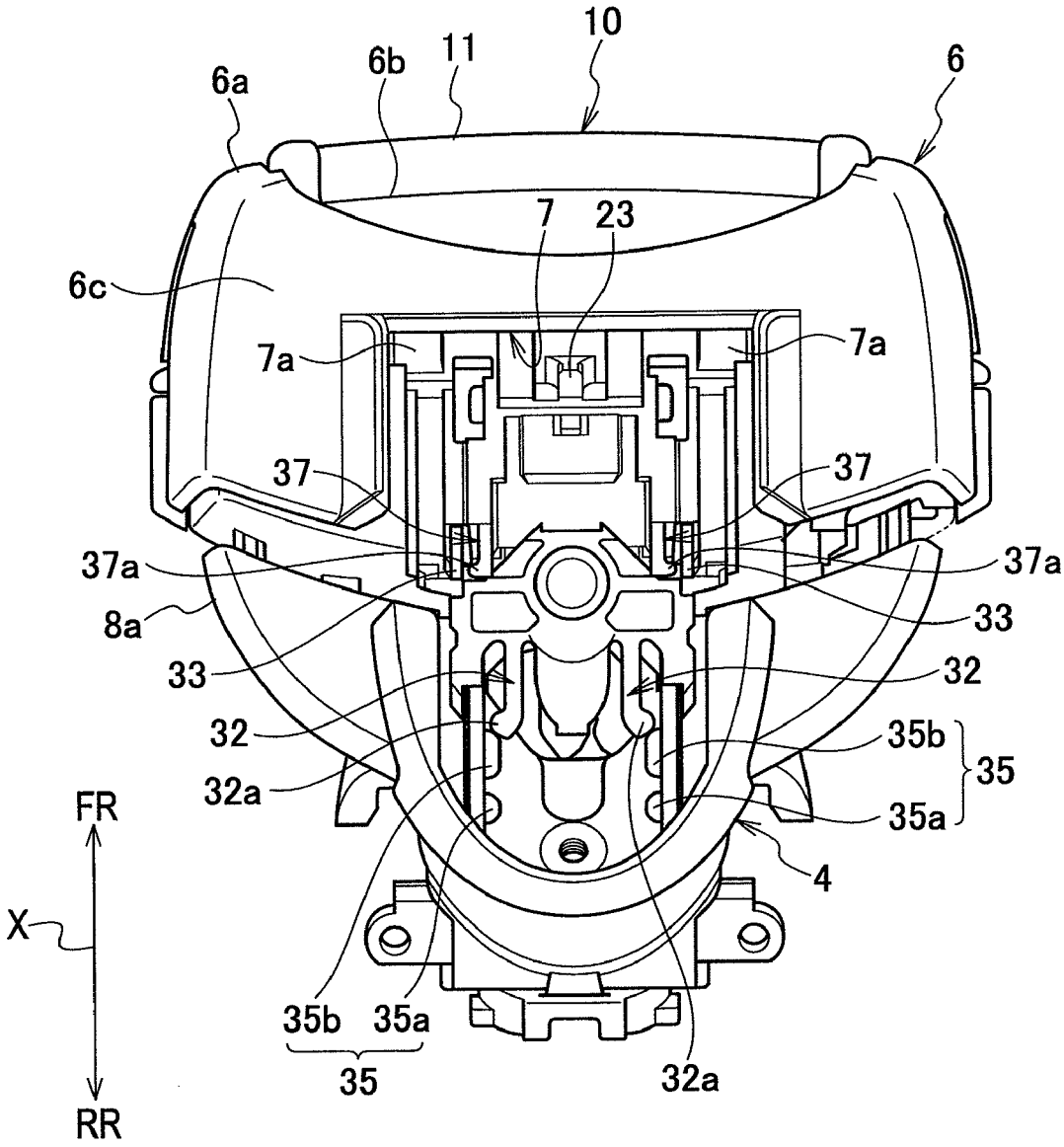
FIG. 14 is a partially-sectional back-side view illustrating the principal portion of the electric shaver at the time of the second operation of the operation element.

In addition, at the time of a second operation (second click) of the operation element 30, that is, when the operation element 30 slides further forward in the sliding-motion direction X from the first-click position and reaches a second-click position shown in FIGS. 5, 8, 11, and 14, each of the leading-end protruding portions 32*a*, 32*a* of the first-click elastic legs 32, 32 abuts on the forward-end portion, in the sliding-motion directions X, of the corresponding second protruding portion 35*b*, as FIG. 14 shows. In addition, each of the second-click elastic legs 33, 33 abuts on the corresponding one of protruding portions 37*a*, 37*a* of a pair of second-click portions 37, 37 (engaging portions for fixing the head portion 6) that protrude from the bottom surface 7*b* of the recessed portion 7 of the head portion 6.

Figure 5:
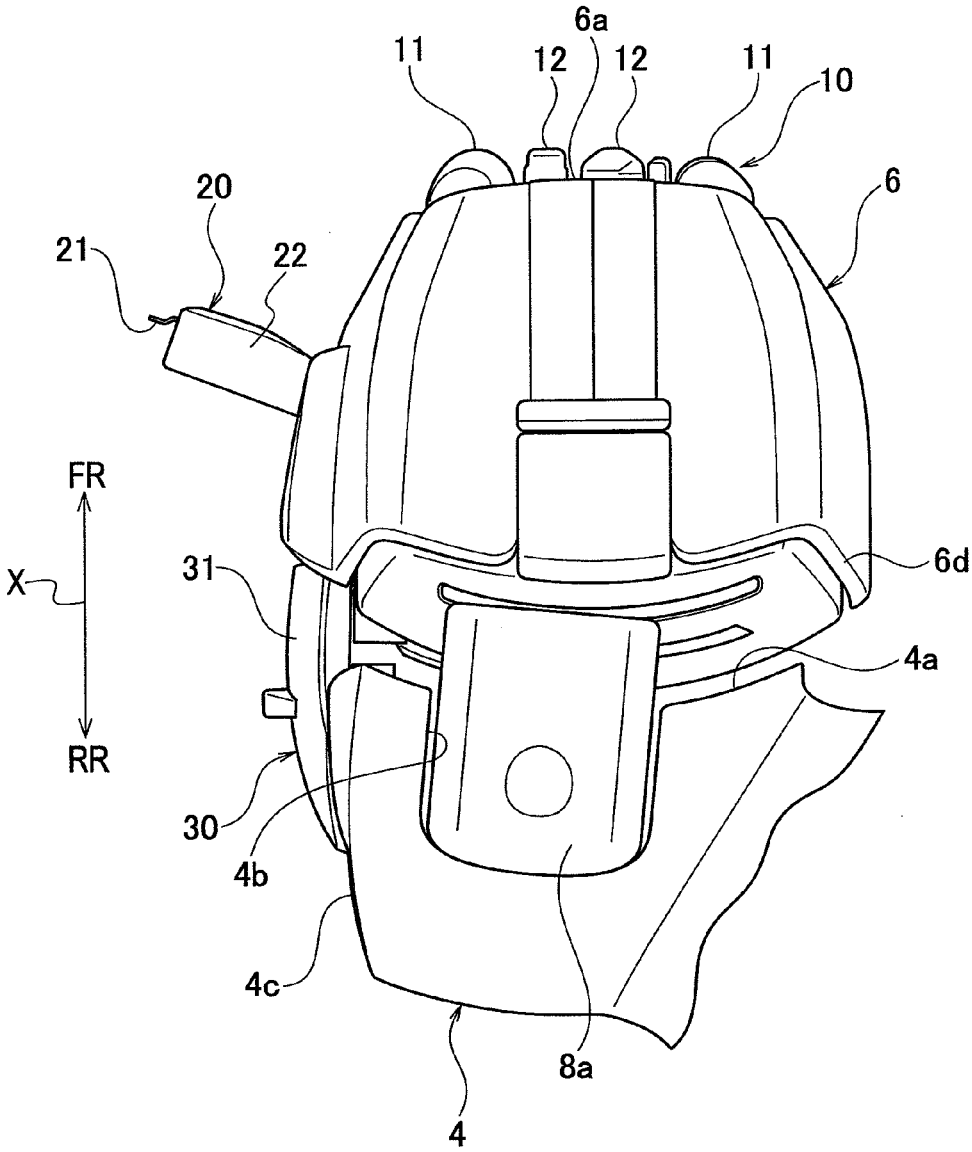
FIG. 5 is a side view illustrating the principal portion of the electric shaver at the time of a second operation of the operation element.
Figure 6:
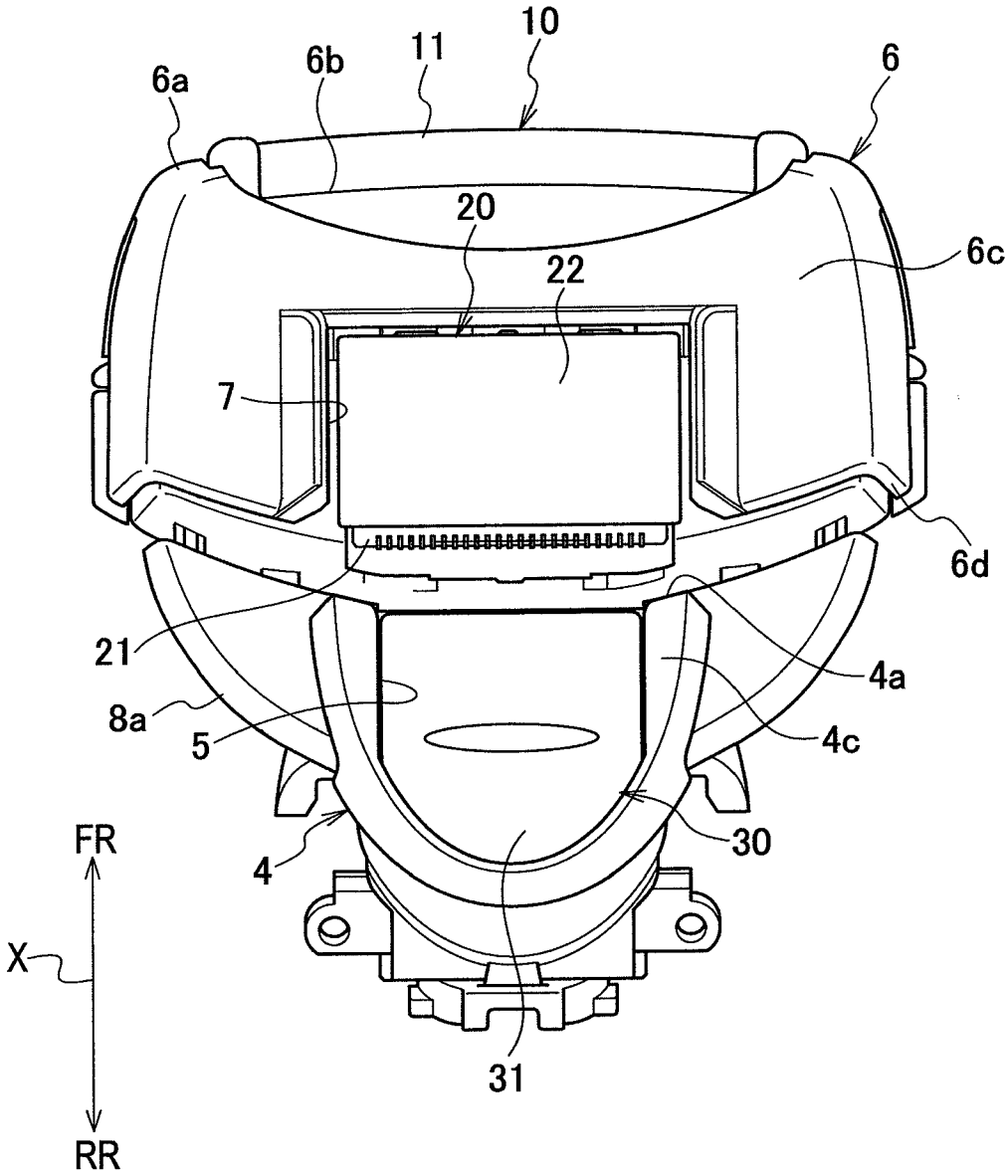
FIG. 6 is a back-side view illustrating the principal portion of the electric shaver before the operation of the operation element.
Figure 7:
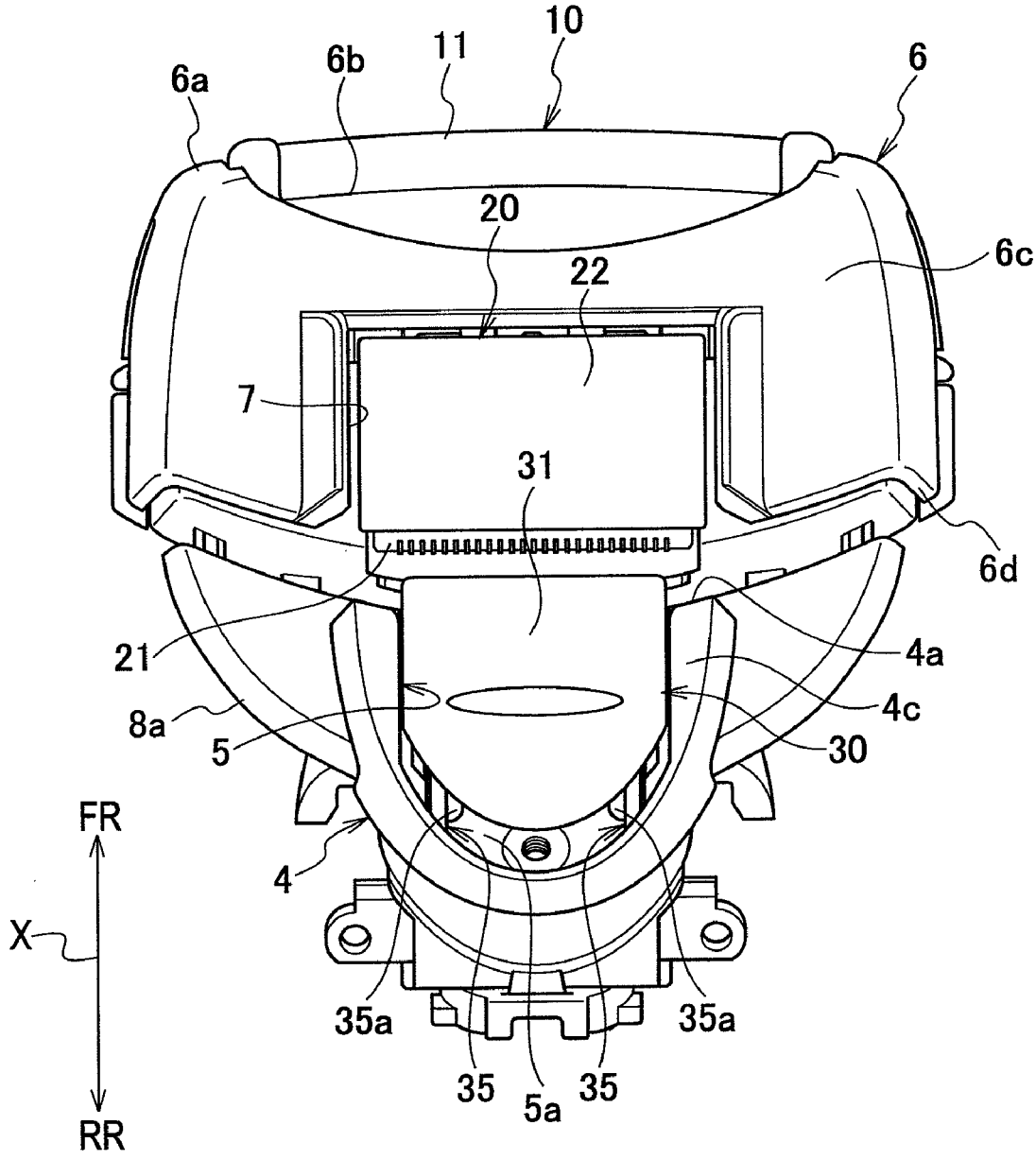
FIG. 7 is a back-side view illustrating the principal portion of the electric shaver at the time of the first operation of the operation element.
Figure 8:
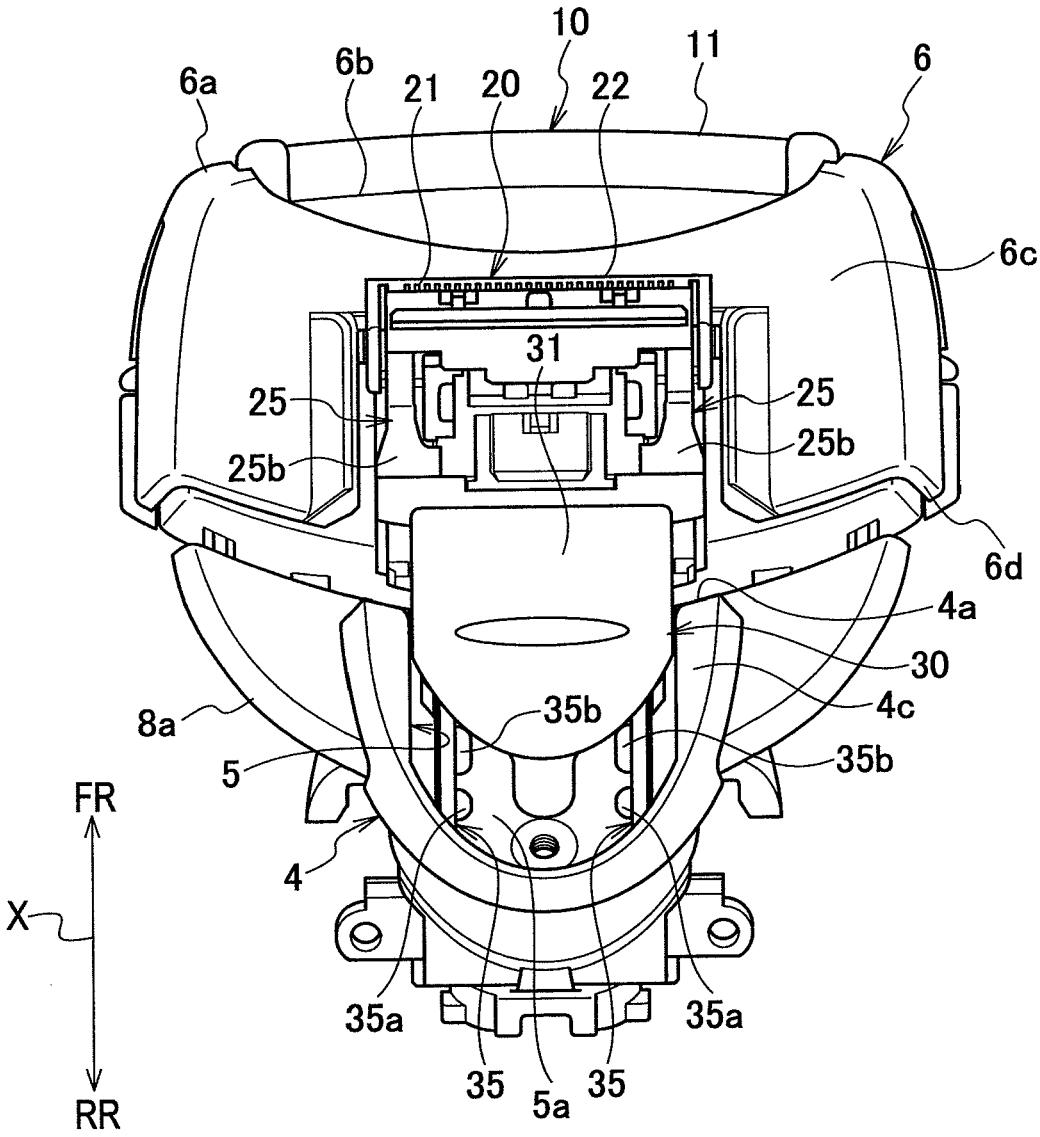
FIG. 8 is a back-side view illustrating the principal portion of the electric shaver at the time of the second operation of the operation element.
Figure 9:
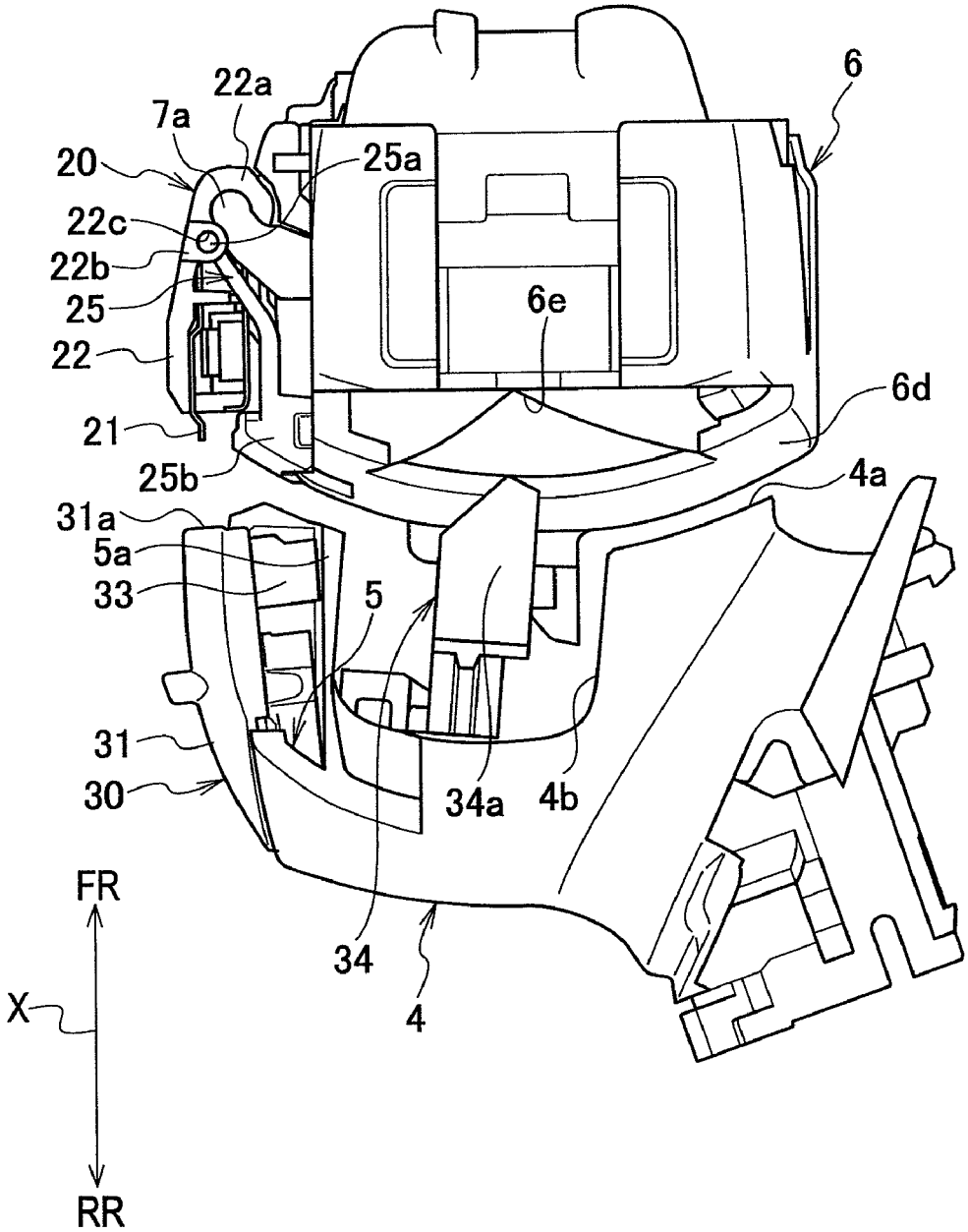
FIG. 9 is a partially-sectional side view illustrating the principal portion of the electric shaver before the operation of the operation element.
Figure 11:
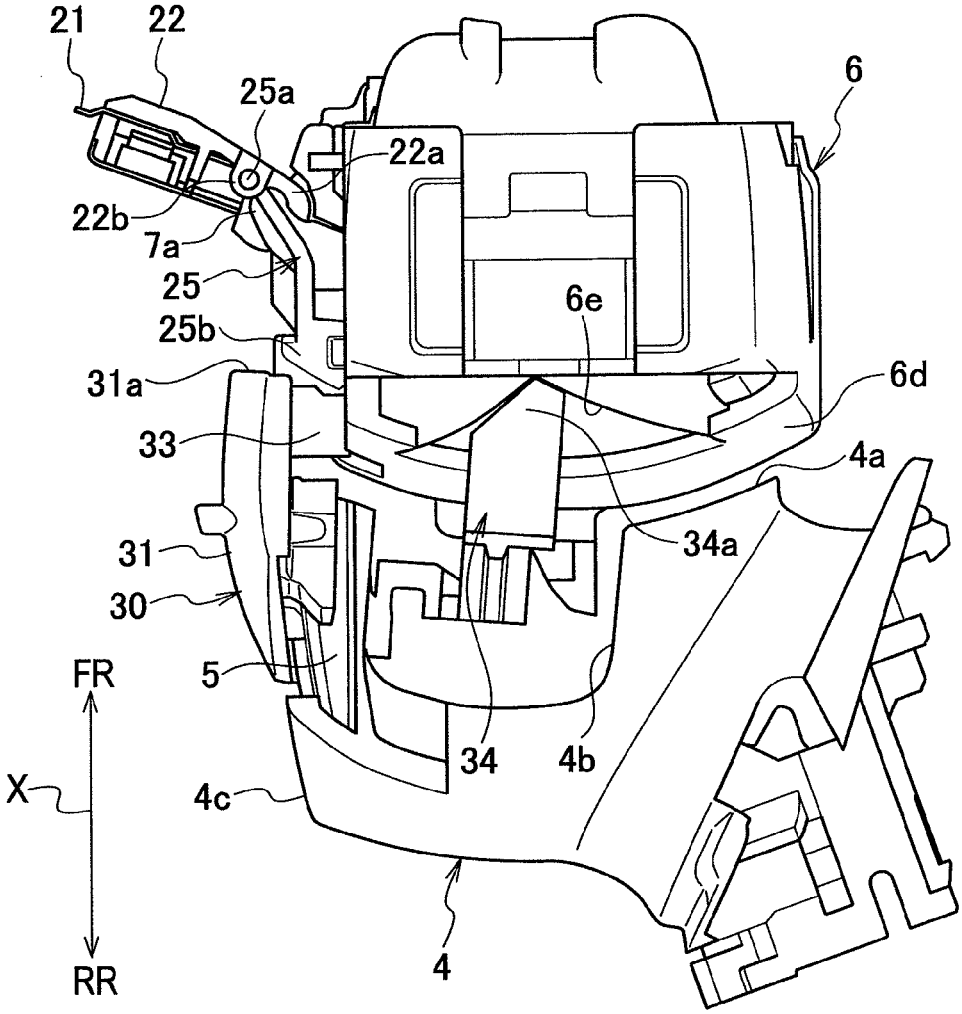
FIG. 11 is a partially-sectional side view illustrating the principal portion of the electric shaver at the time of the second operation of the operation element.

In this state, as FIGS. 5, 8, and 11 show, each handle arm 25 is pushed forward in the sliding-motion direction X by the front-side surface 31*a* of the operation element main body 31 and the corresponding second-click elastic leg 33. Thereby, the state of the edge-trimmer-blade unit 20 is switched from the retracted state where the edge-trimmer-blade unit 20 is stored in the recessed portion 7 of the head portion 6 to the popped-up state where the edge-trimmer-blade unit 20 is ready for use.

As FIGS. 4, 7, 10 and 13 show, according to the electric shaver 1 of the embodiment, as the operation element 30 is operated to slide forwards towards the bottom surface 6*d* of the head portion 6, at the time of the first operation (first click), each of the leading-end protruding portions 32*a*, 32*a* of the pair of first-click elastic legs 32, 32 is fitted to the space formed between the first protruding portion 35*a* and the second protruding portion 35*b* of the corresponding one of the pair of first-click portions 35, 35 that are formed respectively on the two side-portions of the recessed portion 5 of the gripper connecting portion 4. In addition, the two leading-end portions 34*a*, 34*a* of the locking member 34 are fitted respectively to the pair of recessed portions 6*e*, 6*e* that are formed respectively in the two side-portions of the bottom surface 6*d* of the head portion 6. Accordingly, the head portion 6 is locked so as to be prohibited from swinging with respect to the gripper portion 2. Consequently, the head portion 6 is fixed to a position with respect to the gripper portion 2.

In addition, as FIGS. 5, 8, 11, and 14 show, as the operation element 30 is operated to slide forwards further towards the bottom surface 6*d* of the head portion 6, at the time of the second operation (second click), each of the leading-end protruding portions 32*a*, 32*a* of the pair of first-click elastic legs 32, 32 abuts on the corresponding one of the second protruding portions 35*b*, 35*b* of the pair of first-click portions 35, 35 that protrude in the recessed portion 5 of the gripper connecting portion 4. In addition, each of the pair of second-click elastic legs 33, 33 abuts on the corresponding one of the protruding portions 37*a*, 37*a* of the pair of second-click portions 37, 37 that protrude from the bottom surface 7*b* of the recessed portion 7 of the head portion 6. Accordingly, the head portion 6 is locked so as to be prohibited completely from swinging with respect to the gripper portion 2. Consequently, the head portion 6 can be reliably prevented from shaking.

As FIGS. 5, 8, and 11 show, at the time of the second operation (second click), the handle arms 25, 25 in the recessed portion 7 of the head portion 6 are pushed forward in the sliding-motion direction X by the operation element 30. Accordingly, the state of the edge-trimmer-blade unit 20 that has been stored in the recessed portion 7 of the head portion 6 is switched to the state where the edge-trimmer-blade unit 20 is popped up to be ready for use. If the operation element 30 is operated to slide backwards from the popped-up state, the handle arms 25, 25 are moved back to their respective original positions by the biasing force of the unillustrated spring member. Accordingly, the edge-trimmer-blade unit 20 is retracted to be stored in the recessed portion 7 of the head portion 6.

As has been described thus far, the edge-trimmer-blade unit 20 configured to be switched between the ready-for-use state and the stored state by the operation element 30 is provided in the recessed portion 7 of the head portion 6. In addition, the second-click portions 37, 37 for fixing the head portion 6 are formed in the recessed portion 7 of the head portion 6. The second-click portions 37, 37 are configured respectively to be engaged with the second-click elastic legs 33, 33 when the operation element 30 is operated to switch the edge-trimmer-blade unit 20 to the ready-for-use state. Accordingly, the switch to lock the head portion 6 is not necessary any longer, and thus the number of constituent parts can be reduced. Consequently the overall structure of the electric shaver 1 can be simplified and the electric shaver 1 can be manufactured at lower cost.

In addition, the operation element 30 configured to switch the state of the edge-trimmer-blade unit 20 between a ready-for-use state and a stored state is provided in the gripper portion 2 in such a manner as to be slidable back and forth. Moreover, the first-click portions 35, 35 are formed in the recessed portion 5 that is formed in the back-side surface 4*c* of the gripper connecting portion 4 of the gripper portion 2. The first-click portions 35, 35 are engaged respectively with and removed respectively from the first-click elastic legs 32, 32. Accordingly, the first-click portions 35, 35 of the gripper portion 2 guarantee the operability of the operation element 30, and the second-click portions 37, 37 of the head portion 6 reliably prevents the head portion 6 from shaking.

In addition, as FIG. 15 shows, the operation element 30 slides back and forth following such an arc-shaped trajectory that as the operation element 30 moves forward in the sliding-motion direction X, the operation element 30 comes closer to the rotating axis Y of the head portion 6. Accordingly, the clicking force of the head portion 6 can be conducted in a direction that is close to the rotating axis Y of the head portion 6, so that the head portion 6 can be reliably prevented from shaking in the rotating direction of the head portion 6 when the head portion 6 is lifted up. To put it differently, when the second-click elastic legs 33, 33 of the operation element 30 are engaged respectively with the protruding portions 37*a*, 37*a* of the second-click portions 37, 37 of the head portion 6, the distance between the vector of the force (clicking force) applied to the head portion 6 by the operation element 30 and the rotating axis Y of the head portion 6 can be shortened. Accordingly, the rotation moment generated around the rotating axis Y of the head portion 6 can be made smaller.

Figure 16:
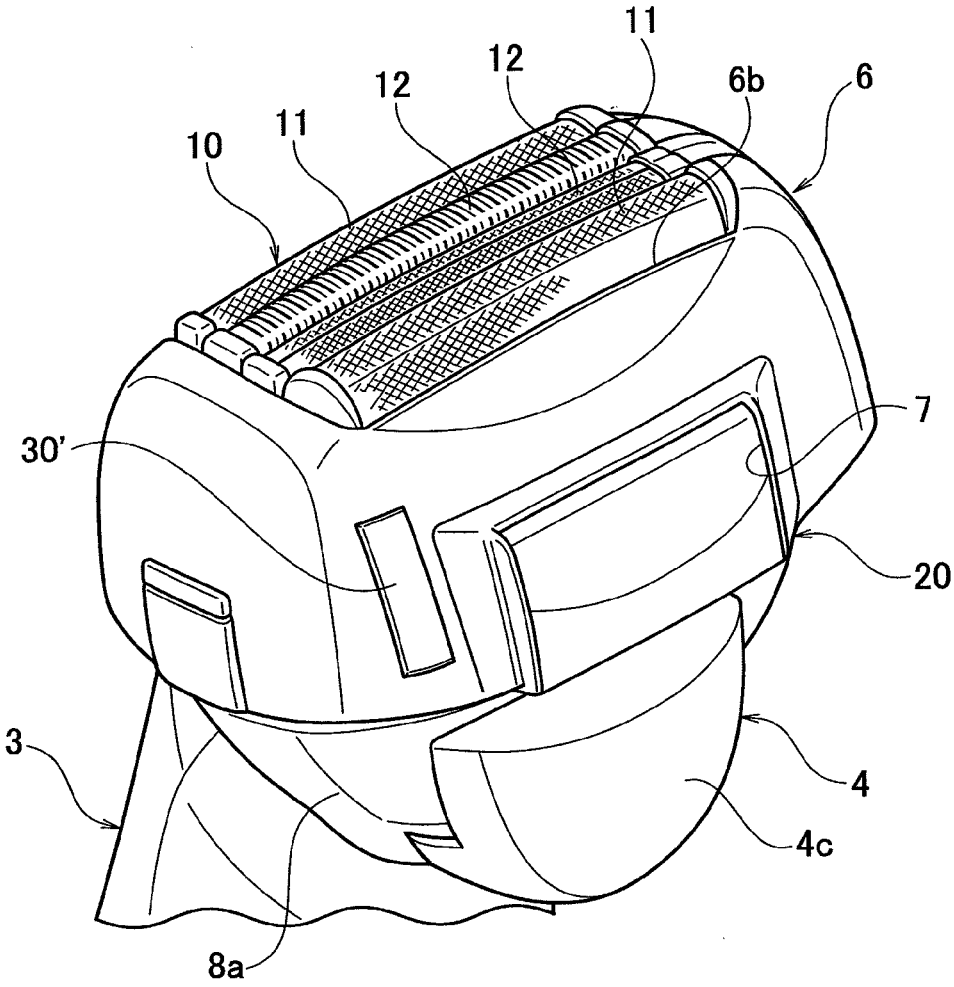
FIG. 16 is a perspective view illustrating a principal portion of an electric shaver according to a second embodiment of the present invention.

FIG. 16 is a perspective view illustrating a principal portion of an electric shaver according to a second embodiment of the present invention.

The second embodiment differs from the first embodiment in that an operation element 30' configured to switch the state of the edge-trimmer-blade unit 20 between the ready-for-use state and the stored state is provided in the head portion 6. The other portions in the configuration of the second embodiment are identical to their respective counterparts in the configuration of the first embodiment. So, the same reference numerals as those used in the first embodiment are given to the identical constituent portions in the second embodiment, and no detailed description for the identical portions will be given.

In this second embodiment, the operation element 30' configured to switch the state of the edge-trimmer-blade unit 20 between the ready-for-use state and the stored state is provided in the head portion 6. Accordingly, there is no operation portion in the gripper portion 2, and thereby the gripper portion 2 becomes easier to grip. In addition, the edge-trimmer-blade unit 20 and the operation element 30' are provided in the head portion 6, so that the driving portion such as the driving lever of the edge-trimmer-blade unit 20 can be stably engaged appropriately when necessary.

The preferred embodiments described herein are illustrative and not restrictive, and the invention may be practiced or embodied in other ways without departing from the spirit or essential character thereof.

A first aspect of the present invention provides an electric shaver including a gripper portion and a head portion. The gripper portion is configured to be held by the user' s hand. The head portion is configured to hold a shaving-blade unit and supported to be swingable in predetermined directions with respect to the gripper portion. In the electric shaver, the head portion includes: an edge-trimmer-blade unit configured to be switched between a ready-for-use state and a stored state by an operation element; and a engaging portion for fixing the head portion, the engaging portion configured to be engaged with the operation element when the edge-trimmer-blade unit is switched to the ready-for-use state by an operation of the operation element.

According to the first aspect of the present invention, no switch to lock the head portion is necessary, so that the number of constituent parts can be reduced. Consequently, the overall structure of the electric shaver can be simplified and the manufacturing cost of the electric shaver can be reduced.

A second aspect of the present invention provides the electric shaver according to the first aspect with the following additional feature. The gripper portion includes: the operation element slidable back and forth, the operation element configured to switch the edge-trimmer-blade unit between the ready-for-use state and the stored state; and a engaging portion configured to be engaged with and removed from the operation element.

According to the second aspect of the present invention, while the operability of the operation element can be guaranteed by the engaging portion of the gripper portion, the engaging portion of the head portion can reliably prevent the shaking of the head portion.

A third aspect of the present invention provides the electric shaver according to the second aspect with the following additional feature. The operation element is slidable back and forth following an arc-shaped trajectory.

According to the third aspect of the present invention, the clicking force of the head portion can be conducted in a direction that is close to the rotating axis of the head portion. Consequently, the head portion can be reliably prevented from shaking in the rotating direction of the head portion when the head portion is lifted up.

A fourth aspect of the present invention provides the electric shaver according to any one of the second and the third aspects with the following additional features. The operation element includes a first elastic leg configured to be engaged with the engaging portion of the gripper portion and a second elastic leg configured to be engaged with the engaging portion of the head portion. When the edge-trimmer-blade unit is switched to the ready-for-use state by the operation of the operation element, the first elastic leg is engaged with the engaging portion of the gripper portion, and the second elastic leg is engaged with the engaging portion of the head portion.

According to the fourth aspect, when the edge-trimmer-blade unit is in the ready-for-use state, the operation element is locked in a position with respect to the gripper portion and the head portion by the first elastic leg and the second elastic leg. Consequently, the head portion can be reliably fixed to the gripper portion.

The present disclosure relates to subject matters contained in Japanese Patent Application No. 2009-006427, filed on Jan. 15, 2009, the disclosures of which is expressly incorporated herein by reference in its entirety.

What is claimed is:

1. An electric shaver comprising:

a gripper portion to be held by the user's hand; and a head portion configured to hold a shaving-blade unit and supported to be swingable in predetermined directions with respect to the gripper portion, wherein the head portion includes:

an edge-trimmer-blade unit supported on the head portion and configured to be switched by an operation element between a ready-for-use state where the edge-trimmer blade unit is in a popped up position, and a stored state where the edge-trimmer-blade unit is in a retracted position; and a head portion engaging portion for fixing the head portion, the head portion engaging portion configured to be engaged with the operation element when the edge-trimmer-blade unit is switched to the ready-for-use state by an operation of the operation element.

2. The electric shaver according to claim 1, wherein the gripper portion includes:

the operation element slidable back and forth, the operation element configured to switch the edge-trimmer-blade unit between the ready-for-use state and the stored state; and a gripper portion engaging portion configured to be engaged with and removed from the operation element.

3. The electric shaver according to claim 2, wherein the operation element is slidable back and forth following an arc-shaped trajectory.

4. The electric shaver according to claim 2, wherein the operation element includes a first elastic leg configured to be engaged with the gripper portion engaging portion, and a second elastic leg configured to be engaged with the head portion engaging portion, and when the edge-trimmer-blade unit is switched to the ready-for-use state by the operation of the operation element, the first elastic leg is engaged with the gripper portion engaging portion, and the second elastic leg is engaged with the head portion engaging portion.

* * * * *